US006493518B2

(12) United States Patent
Park

(10) Patent No.: US 6,493,518 B2
(45) Date of Patent: Dec. 10, 2002

(54) PRINTER, AND CONTROL METHOD THEREOF

(75) Inventor: Gyeong-Ho Park, Suwon (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/905,909

(22) Filed: Jul. 17, 2001

(65) Prior Publication Data

US 2002/0114635 A1 Aug. 22, 2002

(30) Foreign Application Priority Data

Feb. 22, 2001 (KR) ..... 2001-9039

(51) Int. Cl.[7] ..... G03G 15/00
(52) U.S. Cl. ..... 399/23; 399/393
(58) Field of Search ..... 399/23, 393, 43

(56) References Cited

U.S. PATENT DOCUMENTS 3,806,242 A * 4/1974 Reehil ..... 399/23
3,970,384 A * 7/1976 Yamamoto et al. ..... 399/23
4,627,715 A * 12/1986 Kikuno ..... 399/43
4,734,747 A * 3/1988 Okuda et al. ..... 399/23
5,066,977 A * 11/1991 Yoshizuka ..... 399/43
5,732,307 A * 3/1998 Yoshizuka et al. ..... 399/23
5,966,555 A * 10/1999 Nakajima et al. ..... 399/23

* cited by examiner

*Primary Examiner*—Susan S. Y. Lee
(74) *Attorney, Agent, or Firm*—Sughrue Mion, PLLC

(57) ABSTRACT

A printer and a control method thereof. The printer includes an optical scanner for scanning light to a photosensitive medium according to image information, a developing unit for developing an electrostatic latent image formed by the optical scanner, a transfer unit for transferring the image of the photosensitive medium to paper, an engine driving unit for driving the optical scanner and the developing unit, a feed unit having a paper feed distance shorter than an image feed distance, and being disposed at a predetermined position of a main body, for stacking paper, a residual amount sensing unit for sensing a residual amount of paper, and a control unit for controlling the engine driving unit to perform a normal printing mode when the residual amount of paper exceeds a predetermined limit value, and to perform a contamination prevention mode when the residual amount of paper is below the predetermined limit value. As a result, the photosensitive medium is prevented from being contaminated due to lack of paper in the consecutive printing process, by using the feed unit having the paper feed distance shorter than the image feed distance.

8 Claims, 5 Drawing Sheets

PRINTER, AND CONTROL METHOD THEREOF

BACKGROUND OF THE INVENTION

1. Field of the Invention

The present invention relates to a printer and a control method thereof and, more particularly, to an improved printer capable of preventing a photosensitive medium from being contaminated due to lack of paper in a consecutive printing process, by using a feed unit having a paper feed distance shorter than an image feed distance, and a control method thereof.

2. Description of the Related Art

Generally, a printer performs a printing process through the processes of charging an image surface of a photosensitive medium such as a photosensitive belt or photosensitive drum with electricity, varying an electric potential level of the image recording surface according to selectively-scanned light, and forming an electrostatic latent image on the image surface. A charged developing solution is added to the electrostatic latent image, to thus visualize an image.

FIG. 1 is a schematic diagram illustrating a general wet printer. Referring to FIG. 1, a photosensitive medium 1 rotates in an endless track under the support of a driving roller 3*a*, a steering roller 3*b* and a transfer backup roller 3*c*.

A remainder of the electrostatic latent image on the image surface of the photosensitive medium 1 is removed by an eraser 11. Then, the image surface passes through a corona charging device 13, and thus is homogeneously charged to a predetermined potential.

The charged image surface of the photosensitive medium 1 is selectively photosensitized due to a laser beam scanned from a laser scan unit 15, and thus a potential level of the photosensitized region is varied, thereby forming an electrostatic latent image. In addition, a developing unit 16 develops the electrostatic latent image on the image recording surface of the photosensitive medium 1, by using a yellow(Y), magenta(M), cyan(C) or black(K) developing solution from a mixing container 25. That is, the respective color developing solutions are pumped by a pump 26 from the mixing container 25 to a developing roller 17 adjacent to the image surface of the photosensitive medium 1. According to the rotation of the developing roller 17, the developing solutions are added to the electrostatic latent image of the photosensitive medium 1, to form the respective color images. In the developing process, the developing solution dropping into the developing unit 16 is returned to the mixing container 25. The mixing container 25 is filled with the color developing solution where a toner charged to a predetermined potential and a liquid phase carrier are mixed in an appropriate concentration. Here, reference numeral 20 denotes an ink cartridge filled with the high concentration developing solution, and 27 denotes a carrier tank filled with a liquid phase carrier. The developing solution of the appropriate concentration is filled in the mixing container 25 in an appropriate level, by adjusting an amount of the high concentration developing solution and carrier supplied from the ink cartridge 20 and the carrier tank 27, respectively, through valves, V. In addition, the mixing container 25 and the developing unit 16 may be integrated.

After the color image is formed on the image surface according to the developing process, the photosensitive medium 1 is dried in a dry unit 28. Therefore, the liquid phase carrier is removed, while the toner particles remain on the image surface of the photosensitive medium 1. The image of the photosensitive medium 1 is transferred onto a transfer roller 29, and printed on paper 30 passing between the transfer roller 29 and a fixing roller 31.

The paper 30 is picked up from a first feed unit 33 or second feed unit 35 of the printer by feeding rollers 39*a*, 39*b*, 39*c*, and moved along a guide unit 37.

During the consecutive printing process on the paper 30 from the second feed unit 35, the printing process is interrupted if the second feed unit 35 is out of paper 30. Here, since the image to be transferred to the succeeding paper 30 remains on the photosensitive medium 1, it is required to remove the image of the photosensitive medium 1 before re-operating the printer. That is, the residual image is considered as a pollutant. The image remains on the photosensitive medium 1 because a distance between a developing point D of a first color (generally, yellow) and a transfer position B of the image to the paper 30 (hereinafter "image feed distance DB") is longer than a distance between a paper pickup position C of the feed unit 35 and the transfer position B of the image to the paper 30 (hereinafter "paper feed distance CB").

Accordingly, when the printer is interrupted, a cleaning process is required to remove the residual image of the photosensitive medium 1. The repeated cleaning processes, however, may shorten the life span of the cleaning unit. In addition, since the photosensitive medium 1 is rotated several times for the cleaning process, the life span of the photosensitive medium 1 is also shortened. Moreover, even when the printer is interrupted, ink is unnecessarily consumed for the image remaining on the photosensitive medium 1.

SUMMARY OF THE INVENTION

Accordingly, it is an object of the present invention to provide a printer which can prevent a photosensitive medium from being contaminated due to lack of paper in a consecutive printing process, by using a feed unit having a paper feed distance shorter than an image feed distance, and a control method thereof.

In order to accomplish the above-described object of the present invention, there is provided a printer including: an optical scanner for scanning light to a photosensitive medium according to image information; a developing unit for developing an electrostatic latent image formed by the optical scanner; a transfer unit for transferring the image of the photosensitive medium to paper; an engine driving unit for driving the optical scanner and the developing unit; a feed unit having a paper feed distance shorter than an image feed distance, and being disposed at a predetermined position of a main body, for stacking paper; a residual amount sensing unit for sensing a residual amount of paper; and a control unit for controlling the engine driving unit to perform a normal printing mode when the residual amount of paper exceeds a predetermined limit value, and to perform a contamination prevention mode when the residual amount of paper is below the predetermined limit value.

Preferably, the residual amount sensing unit includes: a paper holding lever securely mounted on one side of the feed unit, for slightly pressing the stacked paper; a paper support unit elastically biased by an elastic member opposite to a direction of gravity; and a residual amount sensor disposed at the feed unit, for sensing a position variation of the paper support unit, and measuring the residual amount of paper.

In accordance with a first embodiment of the present invention, when the residual amount of paper equals the predetermined limit value in the contamination prevention mode, the control unit controls the engine driving unit to interrupt the operation of the optical scanner, and to print all the images of the photosensitive medium on the available paper.

In accordance with a second embodiment of the present invention, when the residual amount of paper equals the predetermined limit value in the contamination prevention mode, the control unit varies a predetermined image pitch, and prints the image of the photosensitive medium on the paper according to such varied image pitch.

In addition, a control method of a printer including an optical scanner for scanning light to a photosensitive medium according to image information, a developing unit for developing an electrostatic latent image formed by the optical scanner, and a transfer unit for transferring the image of the photosensitive medium to paper, includes the steps of sensing a residual amount of paper of a feed unit having a paper feed distance shorter than an image feed distance; comparing the residual amount of paper with a predetermined limit value; performing a normal printing mode and returning to the residual paper amount sensing step when the residual amount of paper exceeds the predetermined limit value; and performing a contamination prevention mode when the residual amount of paper is below the predetermined limit value.

In accordance with the first embodiment of the present invention, the contamination prevention mode step includes the steps of varying an image pitch when the residual amount of paper equals the predetermined limit value; forming an image on the photosensitive medium according to the varied image pitch; printing the image on the paper; re-sensing the residual amount of paper; returning to the image formation step when the residual amount of paper is re-sensed; and temporarily interrupting the printing process when the residual amount of paper is not sensed.

In accordance with the second embodiment of the present invention, the contamination prevention mode step includes the steps of interrupting the operation of the optical scanner by controlling the engine driving unit when the residual amount of paper equals the predetermined limit value; printing all the images of the photosensitive medium on the available paper by driving a corresponding unit when the optical scanning is interrupted; and temporarily interrupting the operation of the printer when the printing step is finished.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
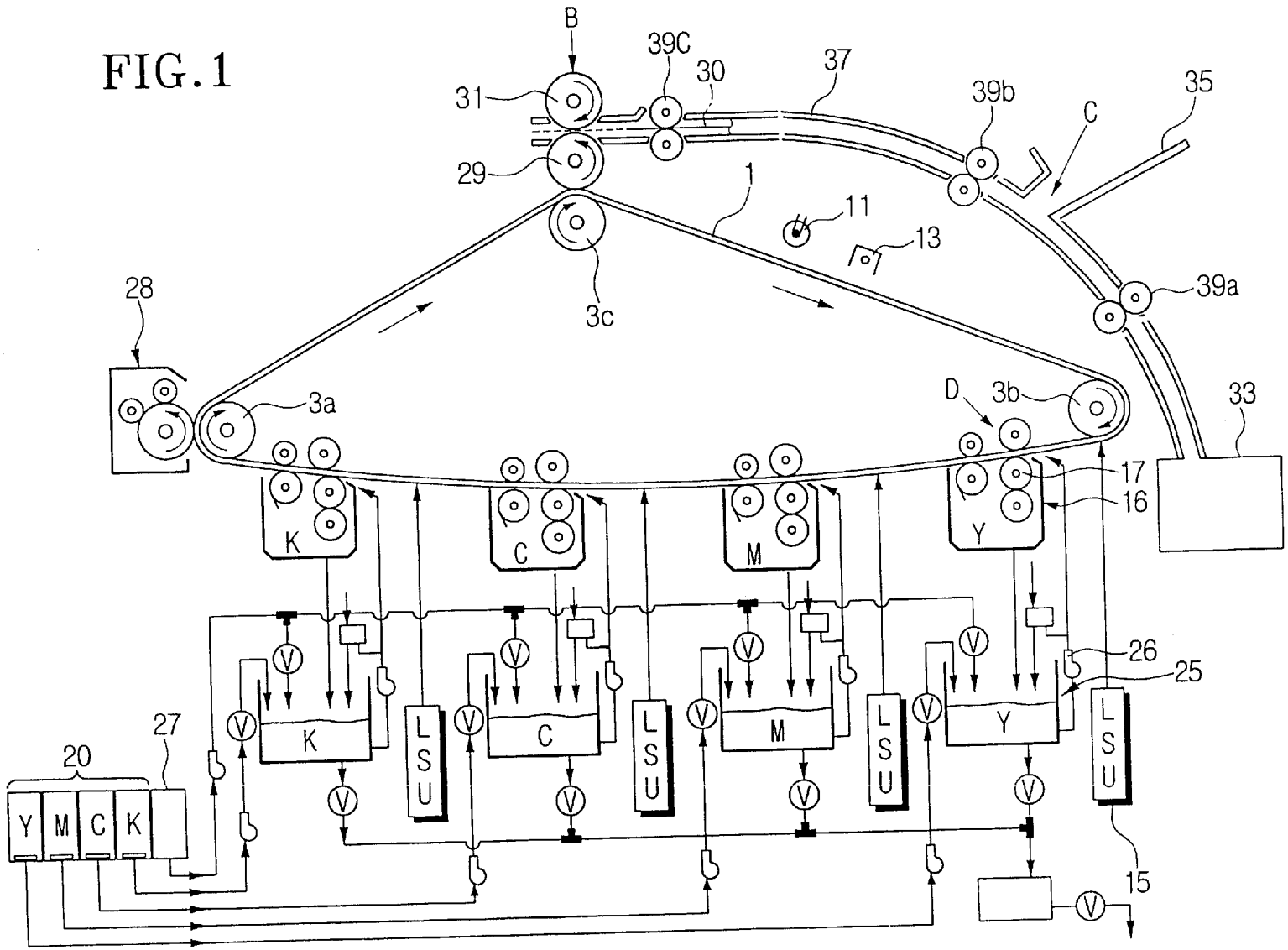
FIG. 1 is a schematic diagram illustrating a general wet printer.

A printer and a control method thereof in accordance with preferred embodiments of the present invention will now be described in detail with reference to the accompanying drawings. Here, identical elements are provided with the same reference numerals, while repetitious explanations thereof are omitted as much as possible.

Figure 2:
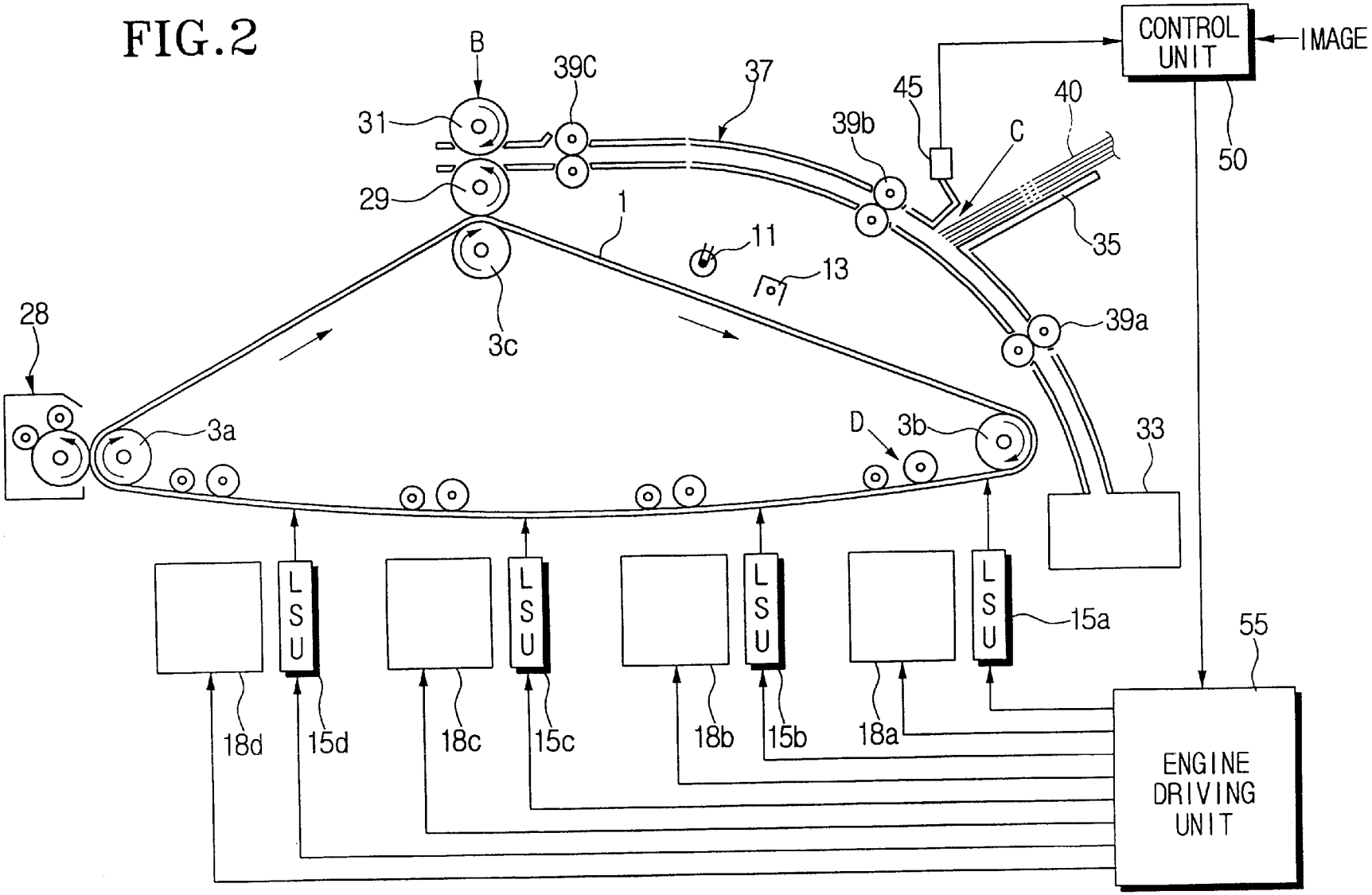
FIG. 2 is a schematic diagram illustrating a printer in accordance with the present invention.

As illustrated in FIG. 2, the printer includes a photosensitive medium 1, optical scanners 15*a*–15*d*, developing units 18*a*–18*d*, transfer units 29, 31, a feed unit 35, a residual sensing unit 45, a control unit 50 and an engine driving unit 55. The optical scanners 15*a*–15*d* and the developing units 18*a*–18*d* are aligned to each color, and controlled by the engine driving unit 55 that is driven under the control of the control unit 50. The optical scanners 15*a*–15*d* scan light to the photosensitive medium 1 according to image information. The developing units 18*a*–18*d* develop an electrostatic latent image formed on the photosensitive medium 1 by the optical scanners 15*a*–15*d*. The transfer units 29, 31 transfer the image of the photosensitive medium 1 to paper 40. The feed unit 35 may be a manual feed unit having a paper feed distance CB shorter than an image feed distance DB. In addition, the feed unit 35 is disposed at a predetermined position of a main body, for stacking the paper 40. The residual sensing unit 45 senses the residual amount of paper 40. The control unit 50 controls the engine driving unit 55 to perform a normal printing mode when the residual amount of paper exceeds a predetermined limit value, and to perform a contamination prevention mode when the residual amount of paper is below the predetermined limit value.

In this embodiment, it is presumed that one rotation of the photosensitive medium 1 prints three (3) pages of images. Thus, the predetermined limit value of the residual paper amount is determined as three (3) pages in this embodiment. However, such number of pages can be varied according to the specifications of the printer or upon the user's request.

In the contamination prevention mode, when the residual amount of paper equals the predetermined limit value, the control unit 50 controls the engine driving unit 55 to interrupt the operation of the developing units 18*a*–18*d*. In addition, in a state where the optical scanning is interrupted, the control unit 50 drives a corresponding unit so that all the images of the photosensitive medium 1 can be printed on the available paper 40, and temporarily interrupts the whole printing process.

Since the images are formed on the photosensitive medium 1 according to the available pages of the paper 40 stacked on the feed unit 35, unnecessary consumption of ink or toner is prevented.

On the other hand, in the contamination prevention mode, when the residual amount of paper equals the predetermined limit value, the control unit 50 varies an image pitch. The image pitch is an interval for separating the image paper in order to distinguish the image to be developed on the photosensitive medium 1. For example, when the image feed distance DB is 590 mm and the paper feed distance CB is 310 mm, the predetermined image pitch d0 is increased by 280 mm which is a difference between the image feed distance DB and the paper feed distance CB. According to the varied image pitch d1, the image of the photosensitive medium 1 is printed on the paper 40. By varying the image pitch, the image is not formed on the photosensitive medium 1 in the event that there is no residual amount of paper 40 available. Therefore, unnecessary consumption of ink or toner is prevented, and contamination of the photosensitive medium 1 is also prevented. As a result, life span deterioration of a cleaning unit (not shown) and the photosensitive medium 1 is prevented.

The residual sensing unit 45 is disposed at one side of the feed unit 35, for determining the residual amount of paper 40 and existence/absence of paper 40. A general optical sensor, such as piezoelectric sensor or other sensors may be used as the residual sensing unit 45.

Figure 3:
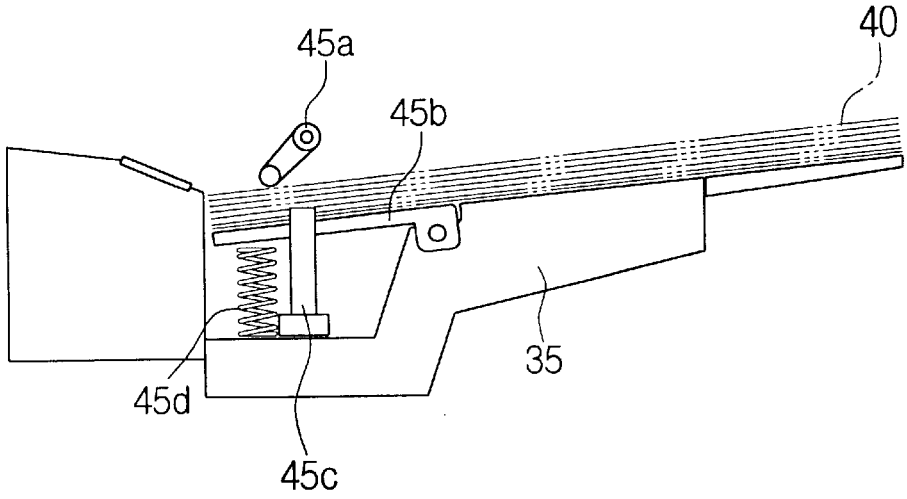
FIG. 3 is a structure diagram illustrating the sensing unit of FIG. 2.

Referring to FIG. 3, the residual sensing unit 45 includes a paper holding lever 45*a*, an elastically-biased paper support unit 45*b*, and a residual sensor 45*c*. The paper holding lever 45*a* is fixed to one side of the feed unit 35, for slightly pressing stacked paper 40. The paper support unit 45*b* is elastically biased by an elastic member such as a spring 45*d* opposite to a direction of gravity. The residual sensor 45*c* is disposed at the feed unit 35, for sensing a position variation of the paper support unit 45*b*, and measuring the residual amount of paper 40.

Figure 4:
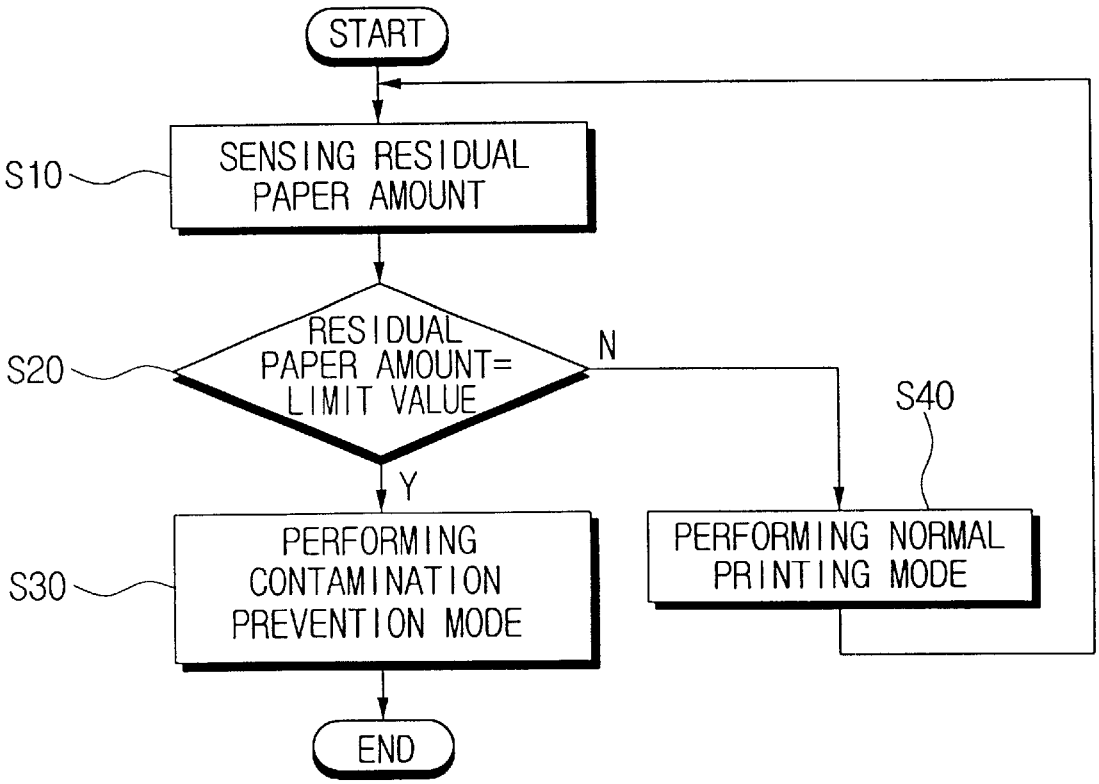
FIG. 4 is a flowchart showing sequential steps of a control method of a printer in accordance with the present invention.

The control method for the printer in accordance with the present invention will now be described with reference to FIG. 4. The control method for the printer includes a residual paper amount sensing step S10, a limit value comparison step S20, a contamination prevention mode step S30 and a normal printing mode step S40.

The residual paper amount sensing step S10 senses the residual amount of paper 40 of the feed unit 35 having the paper feed distance CB shorter than the image feed distance DB. The limit value comparison step S20 compares the residual amount of paper 40 with the predetermined limit value. The limit value can be determined in the production process or by the user. When the residual amount of paper exceeds the predetermined limit value, the normal printing mode step S40 forms the image on the photosensitive medium 1 according to the predetermined image pitch d0, and prints the image on the paper 40. While the normal printing process is performed, the residual amount of paper 40 is consecutively measured. When the residual amount of paper reaches the predetermined limit value, the normal printing mode is interrupted, and the procedure returns to the contamination prevention mode step S30.

Figure 5A:
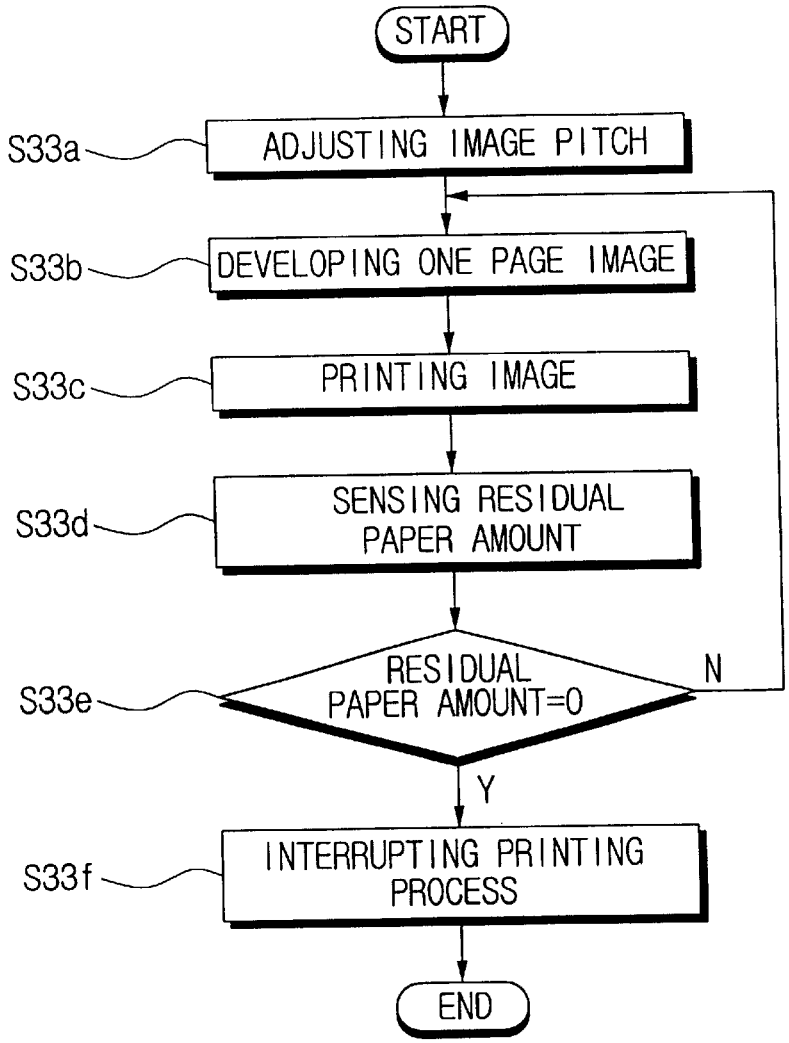
FIG. 5A is a detailed flowchart showing the contamination prevention mode of FIG. 4 in accordance with a first embodiment of the present invention.

The contamination prevention mode step S30 in accordance with the first embodiment of the present invention will now be explained with reference to FIG. 5A.

The contamination prevention mode step S30 includes an image pitch varying step S33*a*, an image forming step S33*b*, a printing step S33*c*, a residual paper amount re-sensing step S33*d*, a no-paper determining step S33*e*, and a temporary interruption step S33*f*.

When the residual amount of paper 40 equals the predetermined limit value, the image pitch varying step S33*a* varies the image pitch d0. The image pitch d0 is set to a predetermined value during the production of the printer. According to the varied image pitch d1, the image forming step S33*b* forms the image on the photosensitive medium 1. The printing step S33*c* prints the image on the paper 40. The residual paper amount re-sensing step S33*d* re-senses the residual amount of paper 40. When the residual amount of paper 40 is sensed, the no-paper determining step S33*e* returns to the image forming step S33*b*. In the case that the residual amount of paper 40 is not sensed, the temporary interruption step S33*f* temporarily interrupts the whole printing process, and notifies the no-paper state so that the user can additionally provide paper to the printer.

In addition, the contamination prevention mode may also be performed by controlling a rotation period of the photosensitive medium 1, provided that a mechanical control is available.

Figure 5B:
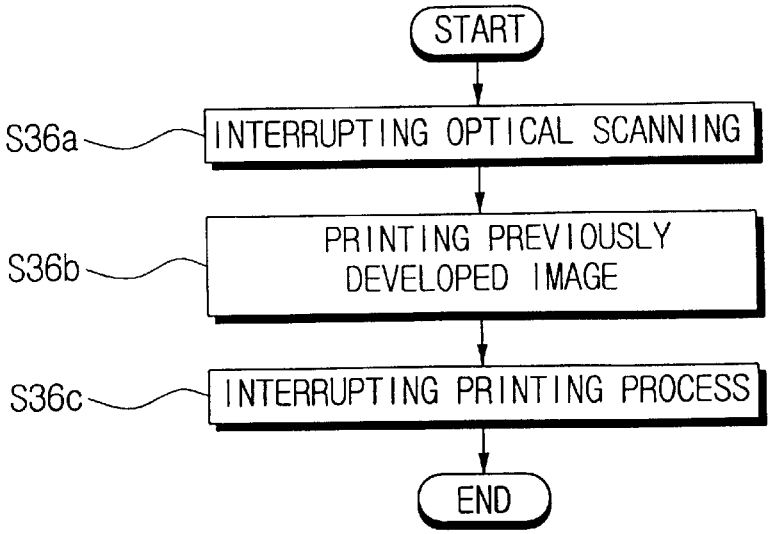
FIG. 5B is a detailed flowchart showing the contamination prevention mode of FIG. 4 in accordance with a second embodiment of the present invention.

The contamination prevention mode step S30 in accordance with the second embodiment of the present invention will now be explained with reference to FIG. 5B.

The contamination prevention mode step S30 includes an optical scanning interruption step S36*a*, a residual image printing step S36*b*, and a temporary interruption step S36*c*.

When the residual amount of paper 40 equals the predetermined limit value, optical scanning interruption step S36*a* interrupts the operation of the optical scanner 15 by controlling the engine driving unit 55. Here, the predetermined limit value can be previously decided so that the image of the photosensitive medium 1 can be printed in a state where the optical scanning is interrupted. When the residual amount of paper reaches the predetermined limit value and the optical scanning is interrupted, the residual image printing step S36*b* drives a corresponding unit so that all the images of the photosensitive medium 1 can be printed on the available paper 40. When the printing process is finished, the operation of the printer is temporarily interrupted, and no-paper state is notified to the user.

Figure 6A:
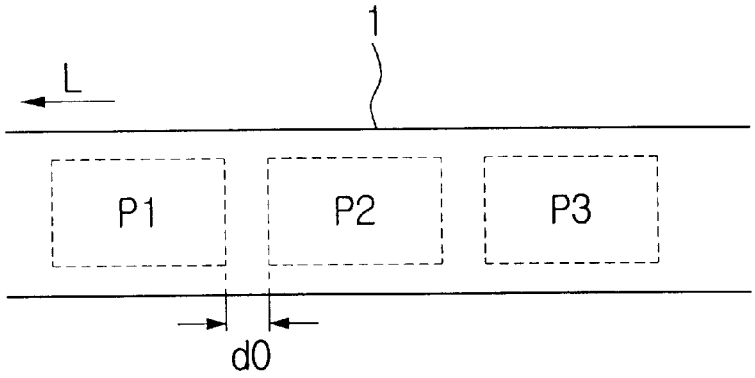
FIG. 6A is a plan view illustrating an image developed on a photosensitive medium in a normal printing mode.

The image formed on the photosensitive medium 1 in the normal printing mode will now be explained with reference to FIG. 6A. A longer arrow L indicates a proceeding direction of the photosensitive medium 1. In the normal printing mode, images P1, P2, P3 corresponding to three pages of paper 40 are formed on the photosensitive medium 1 according to the predetermined image pitch d0.

Figure 6B:
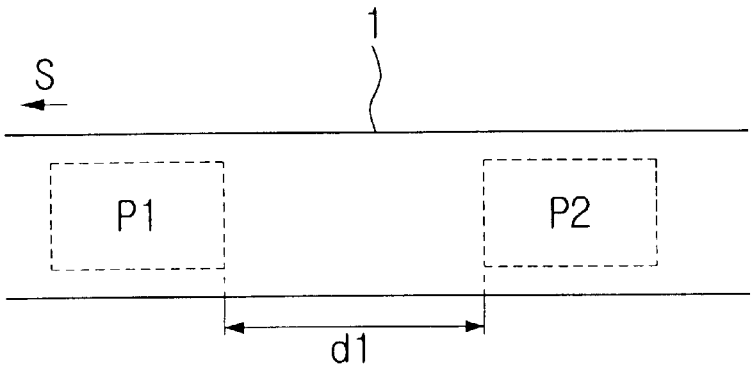
FIG. 6B is a plan view illustrating an image developed on the photosensitive medium in a state where an image pitch is varied in the contamination prevention mode.

The image formed on the photosensitive medium 1 in the contamination prevention mode will now be explained with reference to FIG. 6B. A shorter arrow S indicates a proceeding direction of the photosensitive medium 1. In the contamination prevention mode, the predetermined image pitch d0 is varied to a new image pitch d1. According to the varied image pitch d1, an image P1 corresponding to a first page and an image P2 corresponding to a second page are formed on the photosensitive medium 1. An empty image corresponding to one page is formed between the first image P1 and the second image P2.

As discussed above, in accordance with the present invention, the photosensitive medium 1 is prevented from being contaminated due to lack of paper 40 in the consecutive printing process, by using the feed unit 35 having the paper feed distance shorter than the image feed distance. As compared with the general printer, ink or toner is not unnecessarily consumed by preventing contamination of the photosensitive medium 1. Moreover, the cleaning time of the photosensitive medium 1 is reduced. In addition, life span deterioration of the cleaning unit and the photosensitive medium 1 is prevented.

Although the preferred embodiments of the present invention have been described, it is understood that the present invention should not be limited to these preferred embodiments but various changes and modifications can be made by one skilled in the art within the spirit and scope of the present invention as hereinafter claimed.

What is claimed is:

1. A printer comprising:

an optical scanner that scans light to a photosensitive medium according to image information;

a developing unit that develops an electrostatic latent image formed by the optical scanner;

a transfer unit that transfers the image of the photosensitive medium to paper;

an engine driving unit that drives the optical scanner and the developing unit;

a feed unit having a paper feed distance shorter than an image feed distance, and being disposed at a predetermined position of a main body, the feed unit stacking the paper;

a residual amount sensing unit that senses a residual amount of paper; and a control unit that controls the engine driving unit to perform a normal printing mode when the residual amount of paper exceeds a predetermined limit value, and to perform a contamination prevention mode when the residual amount of paper is below the predetermined limit value.

2. The printer according to claim 1, wherein, when the residual amount of paper equals the predetermined limit value, the control unit controls the engine driving unit to interrupt the operation of the optical scanner and to print the image of the photosensitive medium on the paper.

3. The printer according to claim 1, wherein, when the residual amount of paper equals the predetermined limit value, the control unit varies a predetermined image pitch to a varied image pitch and controls the engine driving unit to print the image of the photosensitive medium on the paper according to the varied image pitch.

4. The printer according to claim 1, wherein the residual amount sensing unit comprises:

a paper holder mounted on the feed unit, the paper holder pressing the stacked paper;

a paper support unit elastically biased by an elastic member opposite to a direction of gravity; and a residual sensor disposed at the feed unit, the residual sensor sensing a position variation of the paper support unit, and measuring the residual amount of paper.

5. A control method of printing using a printer including an optical scanner that scans light to a photosensitive medium according to image information, a developing unit that develops an electrostatic latent image formed by the optical scanner, and a transfer unit that transfers the image of the photosensitive medium to paper, the control method comprising the steps of:

sensing a residual amount of paper of a feed unit having a paper feed distance shorter than an image feed distance;

comparing the residual amount of paper with a predetermined limit value;

performing a normal printing mode and returning to the step of sensing a residual amount of paper when the residual amount of paper exceeds the predetermined limit value; and performing a contamination prevention mode when the residual amount of paper is below the predetermined limit value.

6. The control method according to claim 5, wherein the step of performing a contamination prevention mode comprises the steps of:

varying an image pitch when the residual amount of paper equals the predetermined limit value;

forming an image on the photosensitive medium according to the varied image pitch;

printing the image on the paper;

re-sensing the residual amount of paper;

returning to the step of forming an image when paper is sensed in the step of re-sensing; and temporarily interrupting the printing process when paper is not sensed in the step of re-sensing.

7. The method according to claim 5, wherein the step of performing a contamination prevention mode comprises the steps of:

interrupting an operation of the optical scanner by controlling an engine driving unit when the residual amount of paper equals the predetermined limit value;

printing the image information scanned on the photosensitive medium on the paper by driving a corresponding unit when the operation of the optical scanner is interrupted; and temporarily interrupting the operation of the printer when the step of printing is finished.

8. The method according to claim 7, wherein the predetermined limit value permits printing of the image information scanned on the photosensitive medium when the optical scanning is interrupted.

* * * * *